US009863066B2

(12) United States Patent
Winters et al.

(10) Patent No.: US 9,863,066 B2
(45) Date of Patent: Jan. 9, 2018

(54) PROCESS TO MANUFACTURE A SPUN-DYED PARA-ARAMID FILAMENT YARN AND SLIVER

(71) Applicant: TEIJIN ARAMID GMBH, Wuppertal (DE)

(72) Inventors: Robin Winters, Bemmel (NL); Regine Zumloh-Nebe, Wuppertal (DE); Christian Norhausen, Leverkusen (DE)

(73) Assignee: TEIJIN ARAMID GMBH, Wuppertal (DE)

( * ) Notice: Subject to any disclaimer, the term of this patent is extended or adjusted under 35 U.S.C. 154(b) by 0 days.

(21) Appl. No.: 15/034,903

(22) PCT Filed: Nov. 18, 2014

(86) PCT No.: PCT/EP2014/074819
§ 371 (c)(1),
(2) Date: May 6, 2016

(87) PCT Pub. No.: WO2015/075006
PCT Pub. Date: May 28, 2015

(65) Prior Publication Data

US 2016/0273132 A1 Sep. 22, 2016

(30) Foreign Application Priority Data

Nov. 22, 2013 (EP) ..... 13194108

(51) Int. Cl.

| | |
|---|---|
| ***D01D 5/26*** | (2006.01) |
| ***D01G 1/06*** | (2006.01) |
| ***D01G 1/10*** | (2006.01) |
| ***D02J 13/00*** | (2006.01) |
| ***D01F 6/60*** | (2006.01) |
| ***D01D 5/06*** | (2006.01) |
| ***D01D 10/02*** | (2006.01) |
| ***D01D 10/04*** | (2006.01) |
| ***D01F 1/04*** | (2006.01) |
| ***D01F 1/06*** | (2006.01) |
| ***D01D 10/06*** | (2006.01) |
| *D01G 1/08* | (2006.01) |

(52) U.S. Cl.
CPC ..... *D01F 6/605* (2013.01); *D01D 5/06* (2013.01); *D01D 10/02* (2013.01); *D01D 10/0409* (2013.01); *D01D 10/06* (2013.01); *D01F 1/04* (2013.01); *D01F 1/06* (2013.01); *D01G 1/08* (2013.01)

(58) Field of Classification Search
CPC ..... D01D 5/06; D01D 5/26; D01D 10/02; D01D 10/06; D01F 1/04; D01F 1/06; D01F 6/605; D01G 1/06; D01G 1/08; D01G 1/10; D02J 13/00
USPC ..... 264/143, 178 F, 184, 211, 211.14, 264/211.15, 233, 234; 19/0.35, 157
See application file for complete search history.

(56) References Cited

U.S. PATENT DOCUMENTS

| | | | | |
|---|---|---|---|---|
| 3,767,756 | A | 10/1973 | Blades | |
| 4,477,526 | A * | 10/1984 | Lauterbach | D01G 1/08 19/0.35 |
| 5,114,652 | A | 5/1992 | Lee | |
| 5,173,236 | A * | 12/1992 | Yang | D01F 6/605 264/184 |
| 2006/0010620 | A1 | 1/2006 | Krabbe et al. | |
| 2013/0157054 | A1* | 6/2013 | Chitrangad | D01D 5/06 428/401 |

FOREIGN PATENT DOCUMENTS

| | | | |
|---|---|---|---|
| JP | S63-243330 | A | 10/1988 |
| JP | 2000-080526 | A | 3/2000 |
| JP | 2012-052250 | A | 3/2012 |
| WO | 2012/055685 | A1 | 5/2012 |

OTHER PUBLICATIONS

Dec. 17, 2014 International Searching Report and Written Opinion issued in International Patent Application No. PCT/EP2014/074819.

* cited by examiner

*Primary Examiner* — Leo B Tentoni
(74) *Attorney, Agent, or Firm* — Oliff PLC

(57) ABSTRACT

Manufacturing a spun-dyed para-aramid filament yarn includes (a) preparing a spin dope comprising a para-aramid polymer, at least one dyestuff and concentrated sulfuric acid, (b) spinning the spin dope through a spinneret to obtain spun filaments, (c) coagulating the spun filaments to obtain coagulated filaments, (d) neutralizing the coagulated filaments to obtain neutralized filaments, (e) washing the neutralized filaments to obtain washed filaments, and (f) drying the washed filaments to obtain dried filaments. In step a) the spin dope includes 17.5 to 18.5% by weight of a para-aramid polymer with respect to the weight of the spin dope, and 4 to 15% by weight of the at least one dyestuff with respect to the weight of the para-aramid polymer plus the at least one dyestuff. In step f) the filaments are hold under a tension in a range from 0.2 to 0.8 cN/dtex.

5 Claims, 1 Drawing Sheet

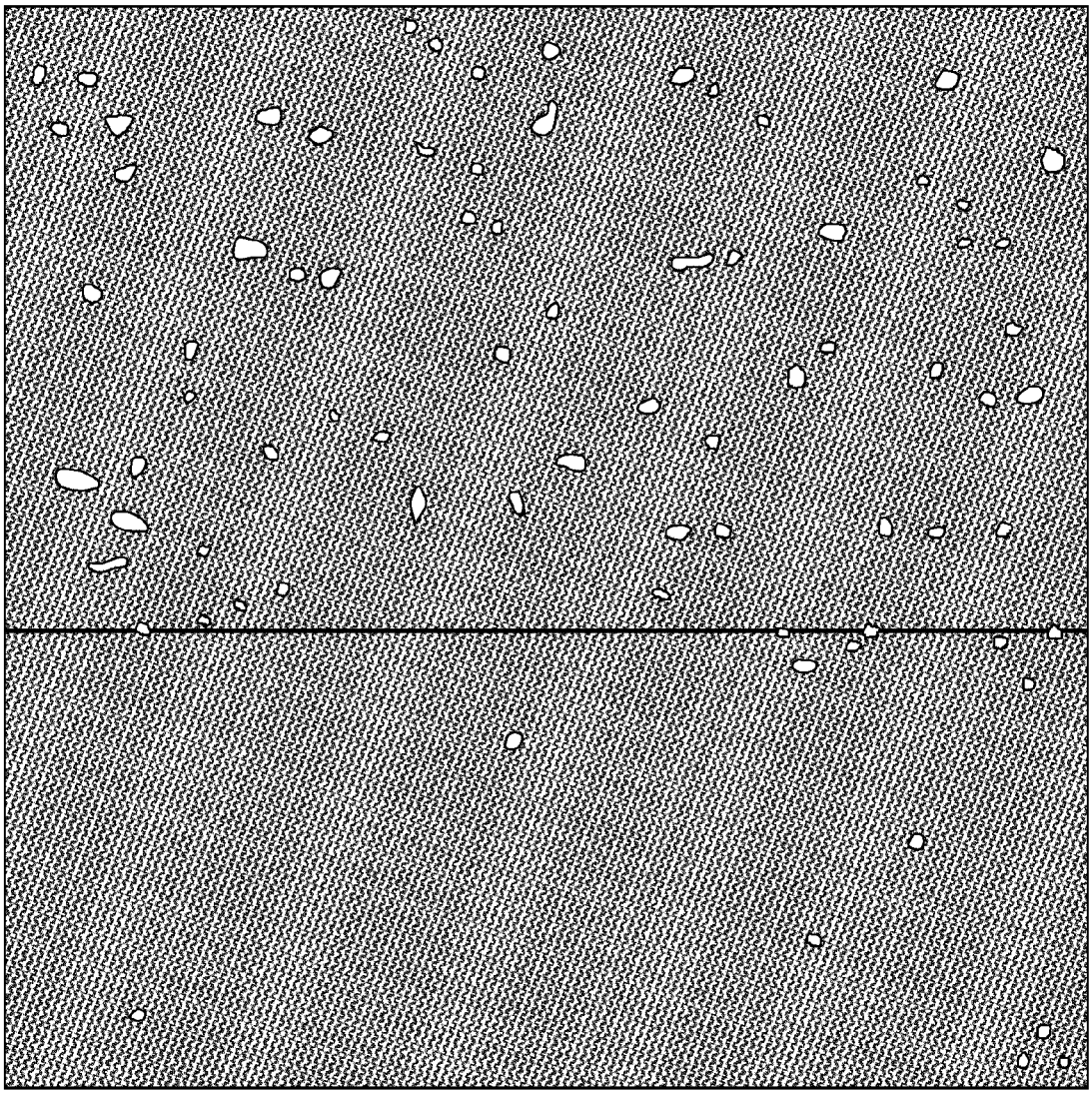

PROCESS TO MANUFACTURE A SPUN-DYED PARA-ARAMID FILAMENT YARN AND SLIVER

BACKGROUND

The disclosure pertains to a process to manufacture a spun-dyed para-aramid filament yarn and a sliver, a sliver, a staple fiber yarn and a textile fabric.

Spun-dyed para-aramid filament yarns are known. To achieve a deeper colour of the spun-dyed filament yarn the concentration of dyestuff in the filament yarn can be increased. However, increasing the concentration of dye in the para-aramid filament yarn increases the tendency of the filament yarn to form intermittent defects in the filaments which extend along the center of the filament fiber axis and exhibit a cylinder-like shape. Said defects can be detected with a microscope at a magnification factor of 50 using visible light.

It was found that, if spun dyed para-aramid filament yarns with said tendency of defect formation are used to manufacture a sliver, the obtained sliver exhibits neps. According to the definition given in C. A. Lawrence in "Fundamentals of Spun Yarn Technology" a nep is a small, tangled knot of fiber often caused by processing fibers.

And it was found that said formation of neps causes fading of the colour of the dye, so that the colour of the sliver is faded in comparison with the colour of the spun-dyed para-aramid filament yarn which was used to manufacture the sliver. Said colour fading of the sliver is especially pronounced, if the sliver is made from stretch-broken staple fibers, but can also be detected, even though less pronounced, in a sliver made from cut staple fibers. If such colour-faded sliver is manufactured into a staple fiber yarn, it was observed that the resulting staple fiber yarn exhibits increased nep formation and correspondingly increased colour fading. And, of course, both nep formation and colour fading are transferred into a textile fabric made from said staple fiber yarn.

Therefore, the problem of the present disclosure is to provide a process resulting in a spun-dyed para-aramid filament yarn which also at an increased concentration of the dye in the filament yarn is at least less susceptible to form the defects described above, and which can be used to manufacture a sliver, a staple fiber yarn from said sliver, and textile fabrics from said staple fiber yarn exhibiting less nep formation and colour-fading.

BRIEF SUMMARY

Said problem is solved by a process to manufacture a spun-dyed para-aramid filament yarn, wherein the process comprises the steps of a) preparing a spin dope comprising a para-aramid polymer, at least one dyestuff and concentrated sulfuric acid,
b) spinning the spin dope through a spinneret to obtain spun filaments,
c) coagulating the spun filaments to obtain coagulated filaments,
d) neutralizing the coagulated filaments to obtain neutralized filaments,
e) washing the neutralized filaments to obtain washed filaments, and
f) drying the washed filaments to obtain dried filaments, characterized in that in step a) the spin dope is prepared of 17.5 to 18.5% by weight of a para-aramid polymer with respect to the weight of the spin dope, and 4 to 15% by weight of the at least one dyestuff with respect to the weight of the para-aramid polymer plus the at least one dyestuff, and in step f) during drying the filaments are hold under a tension in a range from 0.2 to 0.8 cN/dtex.

Surprisingly, the process according to the present disclosure provides a spun-dyed para-aramid filament yarn which also at an increased concentration of the at least one dyestuff in the filament yarn of up to 15% by weight with respect to the weight of the para-aramid polymer plus the at least one dyestuff is less susceptible to form the defects described above.

In preferred embodiments of the process according to the present disclosure the resulting spun-dyed para-aramid filament yarn is free of the defects described above.

Said surprising technical effects are obtained, if in step a) of the process to manufacture said spun-dyed para-aramid filament yarn the spin dope is prepared of 17.5 to 18.5% by weight of a para-aramid polymer with respect to the weight of the spin dope, and 4 to 15% by weight of the at least one dyestuff with respect to the weight of the para-aramid polymer plus the at least one dyestuff and in step f) during drying the filaments are hold under a tension in the range from 0.2 to 0.8 cN/dtex.

Furthermore, it was surprisingly found that, if the spun-dyed para-aramid yarn obtained from the process according to the present was manufactured into a sliver, the obtained sliver exhibits less nep formation and colour fading than a sliver made of a spun-dyed para-aramid filament yarn, which is manufactured in a comparative process, which differs from the process according to the present disclosure only in that the spin dope is prepared with a weight percentage of the para-aramid polymer outside of the range of 17.5 to 18.5% by weight of a para-aramid polymer with respect to the weight of the spin dope, and with a weight percentage of the at least one dyestuff outside of the range of 4 to 15% by weight of the at least one dyestuff with respect to the weight of the para-aramid polymer plus the at least one dyestuff, and during drying the filaments are hold under a tension outside the range from 0.2 to 0.8 cN/dtex.

BRIEF DESCRIPTION OF THE DRAWINGS

The FIGURE shows knitted textile fabrics made according to Example 3 and Comparative Example 3.

DETAILED DESCRIPTION

Within the scope of the present disclosure the term "spun-dyed para-aramid filament yarn" means a yarn consisting of a plurality of filaments comprising a filament-forming para-aramid polymer and at least one dyestuff, wherein the film-forming para-aramid polymer consists of a para-aromatic polyamide, i.e. a copolymer, wherein at least 85% of the amide (—CO—NH—) bonds are directly bonded with two aromatic rings and wherein the co-monomers, which have been polymerized to form said para-aromatic polyamide, are selected from the group consisting of aromatic para-diamines and from the group consisting of aromatic para-dicarboxylic acids or aromatic para-dicarboxylic acid dichlorides.

In the process of the present disclosure a preferred spun-dyed para-aramid filament yarn is a spun-dyed poly(para-phenylene terephthalamide) filament yarn, the filament forming polymer of which is obtained by the mol:mol polymerisation of para-phenylene diamine and terephthalic acid dichloride. Furthermore, as the filament forming polymer for the purposes of the process according to the present disclosure para-aromatic copolymers are suited as well, wherein para-phenylene diamine and/or terephthalic acid are substituted partly or completely by other para-aromatic diamines and/or para-dicarboxylic acids.

Preparing the spin dope in step a) of the process according to the present disclosure can generally be realized by any manner which is capable to result in a homogenous mixture of the spin dope components, i.e. of the para-aramid polymer, the at least one dyestuff, and concentrated sulfuric acid. For example such a manner comprises the steps of i) preparing a mixture of the at least one dyestuff with a sandy spin dope consisting of a para-aramid polymer, e.g. of poly(para-phenylene terephthal-amide), and concentrated sulfuric acid which contains preferably at least 80% by weight $H_2SO_4$, more preferably at least 79% by weight $H_2SO_4$, and most preferred from 79.6 to 81.8% by weight $H_2SO_4$, so that the mixture contains 17.5 to 18.5% by weight of a para-aramid polymer with respect to the weight of the spin dope, and 4 to 15% by weight of the at least one dyestuff with respect to the weight of the para-aramid polymer plus the at least one dyestuff, ii) transporting the mixture into a single or double screw extruder, or into a single or double shaft kneader, and iii) heating the mixture in the extruder or kneader to a temperature in the range of preferably 70 to 90° C., more preferably to 85° C.

In a preferred embodiment of the process according to the present disclosure in step a) the spin dope is prepared of 5 to 11% by weight of the at least one dyestuff with respect to the weight of the para-aramid polymer plus the at least one dyestuff.

In a more preferred embodiment of the process according to the present disclosure in step a) the spin dope is prepared of 6 to 9% by weight of the at least one dyestuff with respect to the weight of the para-aramid polymer plus the at least one dyestuff.

In an especially preferred embodiment of the process according to the present disclosure in step a) the spin dope is prepared of 6.5 to 7.5% by weight of the at least one dyestuff with respect to the weight of the para-aramid polymer plus the at least one dyestuff.

Within the scope of the present disclosure the term "at least one dyestuff" means one or two or three or more of coloured chemical compounds each of which is capable to provide a para-aramid filament yarn with colour.

In a preferred embodiment of the process according to the present disclosure for the at least one dyestuff used to prepare the spin dope in step a) at least one pigment is chosen. Preferably said at least one pigment is an organic pigment, so that for example two or three organic pigments may be used to prepare the spin dope, provided that the sum of the weight percentages of said two or three pigments amounts to 4 to 15% by weight with respect to the weight of the para-aramid polymer plus pigments.

In an especially preferred embodiment of the process according to the present disclosure the at least one dyestuff consists of (a) a yellow organic pigment, especially preferred of C.I. Pigment Yellow 147, i.e. 1,1'[(6-Phenyl-1,3,5-triazine-2,4-diyl)diimino]bisanthraquinone, (b) a red organic pigment, especially preferred of C.I. Pigment Red 122, i.e. 5,12-Dihydro-2,9-dimethylquino[2,3-b]acridine-7,14-dione, and (c) a blue organic pigment, especially preferred of C.I. Pigment Blue 15, i.e. (29H,31H-phthalocyaninato(2-)-N29,N30,N31,N32)copper, so that the resulting spun-dyed para-aramid filament yarn is black.

In the process according to the present disclosure step b) of spinning the spin dope through a spinneret to obtain spun filaments preferably comprises spinning the dope into an air gap.

In the process according to the present disclosure step c) of coagulating the spun filaments to obtain coagulated filaments preferably occurs in a coagulation bath consisting of water or aqueous sulfuric acid.

In the process according to the present disclosure step d) of neutralizing the coagulated filaments is performed in a separate washing section bath with diluted alkali and step e) of washing the neutralized filaments is also performed in a separate section containing water.

In the process according to the present disclosure the washed filaments resulting from step e) are directly introduced into drying step f) into a drying means, and during drying the filaments are hold under a tension in a range from 0.2 to 0.8 cN/dtex, preferably in a range from 0.3 to 0.7 cN/dtex, and most preferred in a range from 0.4 to 0.6 cN/dtex. That can be realized for example by wrapping the filaments around turning heated drying drums, with different spinning speeds to set the tension. In the drying means the filaments are hold under a tension in one of said tension ranges, and are dried to a water content which preferably is ≤10%, more preferred 8%, and especially preferred 7% by weight always with respect to the weight of the filaments. The temperature in the drying means is preferably in a range from 80 to 250° C., more preferred in a range from 110 to 200° C.

After the drying step the dried filaments exhibit a modulus measured according to ASTM D7269 preferably in the range of 50 to 67 GPa, especially preferred in the range of 53 to 62 GPa.

In the process according to the present disclosure the dried spun-dyed para-aramid filament yarn may be wound, e.g. on a bobbin.

As already mentioned, the spun-dyed para-aramid filament yarn obtained from the process described before can be used to prepare a sliver which exhibits less nep formation and colour fading than a sliver made of a spun-dyed para-aramid filament yarn, which is manufactured in a comparative process, which differs from the process according to the present disclosure only in that the spin dope is prepared with a weight percentage of the para-aramid polymer outside of the range of 17.5 to 18.5% by weight of a para-aramid polymer with respect to the weight of the spin dope, and with a weight percentage of the at least one dyestuff outside of the range of 4 to 15% by weight of the at least one dyestuff with respect to the weight of the para-aramid polymer plus the at least one dyestuff, and during drying the filaments are hold under a tension outside the range from 0.2 to 0.8 cN/dtex.

Therefore, a process to manufacture a sliver made of spun-dyed para-aramid staple fibers is also part of the present disclosure. Said process is characterized in that it comprises the steps of g) conducting dried spun-dyed para-aramid filament yarn obtained with the filament yarn manufacturing process according to the present disclosure into a cutting device or into a stretch-breaking device to obtain cut staple fibers or stretch-broken staple fibers, and h) processing the staple fibers into a sliver.

In step g) of the sliver-manufacturing process according to the present disclosure the dried spun-dyed para-aramid filament yarn obtained with the filament yarn manufacturing process according to the present disclosure can be conducted into the cutting device or into the stretch-breaking device directly after having passed drying step f) of the disclosed process to manufacture the spun-dyed para-aramid filament yarn.

Alternatively, in step g) of the sliver-manufacturing process according to the present disclosure the dried spun-dyed para-aramid filament yarn obtained in step f) of the filament yarn manufacturing process according to the present disclosure can be wound e.g. on a bobbin, for example for the purposes of storage and/or transport, and thereafter unwound and conducted into the cutting device or into the stretch-breaking device.

In step h) of the sliver-manufacturing process according to the present disclosure the staple fibers can be processed into a sliver for example by opening and carding cut staple fibers or by stretch-breaking the filament yarn which directly results in a sliver.

Furthermore, a sliver made of spun-dyed para-aramid staple fibers and obtainable from the sliver-manufacturing process according to the present disclosure is part of the present disclosure. Said sliver is characterized to exhibit a number of neps per mg of sliver $n_{neps}/mg_{silver}$ of less than 60.

In a preferred embodiment of the sliver according to the present disclosure $n_{neps}/mg_{sliver}$ ranges from 1 to 50.

In an especially preferred embodiment of the sliver according to the present disclosure $n_{neps}/mg_{silver}$ ranges from 2 to 45.

Furthermore, a staple fiber yarn comprising, preferably consisting of, the sliver according to the present disclosure or obtained from the sliver-manufacturing process according to the present disclosure, is part of the present disclosure.

Finally, a textile fabric comprising, preferably consisting of, the staple fiber yarn according to the present disclosure belongs to the present disclosure.

In preferred embodiments of the textile fabric according to the present disclosure the textile fabric is a woven or knitted textile fabric.

In the present disclosure the $n_{neps}/mg_{sliver}$ was measured as described in the following: Two samples were taken at random positions of a sliver obtained from stretch-broken spun-dyed staple fibers, and the weight of each of the sliver-samples was determined. Said samples were laid onto an object plate, capped with a cover glass, and inserted in a light microscope. Under the light microscope photos were taken at a magnification of 90:1. The neps on said photos were counted, and the resulting number of neps was calculated for 1 mg sliver.

The present disclosure is explained in more detail in the following examples.

EXAMPLE 1

Manufacture of a Spun-dyed Para-aramid Filament Yarn (i) Preparation of a Sandy Spin Dope and of a Pigment Pre-mix A sandy spin dope was prepared consisting of 19.3 wt. % poly(p-phenylene terephthalamide) (PPTA) in concentrated sulphuric acid, i.e. 99.8 wt. % $H_2SO_4$.

The PPTA had a relative viscosity $n_{rel}$ of 4.8 to 5.2. $n_{rel}$ was measured in a solution of 0.25% $mass_{PPTA}/volume_{H2SO4}$ in 96 wt. % $H_2SO_4$ at 25° C.

The following three pigments (1) C.I. Pigment Yellow 147, i.e. 1,1'[(6-Phenyl-1,3,5-triazine-2,4-diyl)diimino]bisanthraquinone, (2) C.I. Pigment Red 122, i.e. 5,12-Dihydro-2,9-dimethylquino[2,3-b]acridine-7,14-dione, and (3) C.I. Pigment Blue 15, i.e. (29H,31H-phthalocyaninato (2-)-N29,N30,N31,N32)copper were mixed in a ratio (1):(2):(3)=1:1:1 in 99.8 wt. % $H_2SO_4$ to obtain a pigment pre-mix, wherein the total amount of pigments in $H_2SO_4$ was 18 wt. % with respect to the weight of $H_2SO_4$ plus the pigments, (ii) Preparation of a Coloured Sandy Spin Dope The pigment pre-mix and the sandy spin dope obtained in (1) were both fed to a single shaft kneader, resulting in a coloured sandy spin dope, so that the coloured sandy spin dope exhibited 17.9% by weight of PPTA with respect to the weight of the coloured sandy spin dope, and 7% by weight of pigments with respect to the weight of PPTA plus pigments.

(iii) Spinning of the Dope

The coloured sandy spin dope obtained in (ii) was transported into a single shaft kneader, heated in the single shaft kneader at a temperature in the range of 80 to 85° C. and spun through an orifice into an air gap and then into a coagulation bath consisting of aqueous sulphuric acid (10 wt.) to obtain coagulated filaments. The coagulated filaments were washed with water and diluted alkali. The washed filaments were dried on rolling heated drums with different speeds to control the tension of the filaments. In this case the drying temperature was 170° C. and the filaments were hold under a tension of 0.48 cN/dtex. After drying the filaments were wound resulting in a spun dyed PPTA multifilament yarn (yarn titer: 3360 dtex, 2000 individual filaments).

COMPARATIVE EXAMPLE 1

Manufacture of a Comparative Spun-dyed Para-aramid Filament Yarn

Comparative example 1 was performed as example 1 with the only differences that in (i) the sandy spin dope had a concentration of 19.3% by weight of PPTA with respect to the weight of the coloured sandy spin dope and in (iii) the drying tension was 0.95 cN/dtex.

EXAMPLE 2

Manufacture of a Sliver

The spun-dyed PPTA multifilament yarn obtained from example 1 was stretch-broken in a conventional stretch-breaking machine to obtain a sliver which exhibited $n_{neps}/mg_{sliver}$=39.

COMPARATIVE EXAMPLE 2

Manufacture of a Comparative Sliver

The spun-dyed PPTA multifilament yarn obtained from comparative example 1 was stretch-broken in the same stretch-breaking machine as used in example 2 to obtain a comparative sliver which exhibited $n_{neps}/mg_{sliver}$=75.

EXAMPLE 3

Manufacture of a Staple Fiber Yarn and of a Textile Fabric

The sliver obtained in example 2 was processed into a staple fiber yarn. The staple fiber yarn was processed into a knitted textile fabric. The knitted textile fabric is shown on bottom of the FIGURE.

COMPARATIVE EXAMPLE 3

Manufacture of a Comparative Staple Fiber Yarn and of a Comparative Textile Fabric The comparative sliver obtained in comparative example 2 was processed into a comparative staple fiber yarn. The comparative staple fiber yarn was processed into a comparative knitted textile fabric. The comparative knitted textile fabric is shown on top of the figure.

The invention claimed is:

1. A process to manufacture a spun-dyed para-aramid filament yarn, the process comprising:

a) preparing a spin dope comprising a para-aramid polymer, at least one dyestuff, and concentrated sulfuric acid, b) spinning the spin dope through a spinneret to obtain spun filaments, c) coagulating the spun filaments to obtain coagulated filaments, d) neutralizing the coagulated filaments to obtain neutralized filaments, e) washing the neutralized filaments to obtain washed filaments, and f) drying the washed filaments to obtain dried filaments, wherein in step a) the spin dope comprises 17.5 to 18.5% by weight of a para-aramid polymer with respect to the weight of the spin dope, and 4 to 15% by weight of the at least one dyestuff with respect to the weight of the para-aramid polymer plus the at least one dyestuff, and in step f) during drying the filaments are held under a tension in a range from 0.2 to 0.8 cN/dtex.

2. The process according to claim 1, wherein in step a) the spin dope comprises 5 to 11% by weight of the at least one dyestuff with respect to the weight of the para-aramid polymer plus the at least one dyestuff.

3. The process according to claim 2, wherein in step a) the spin dope comprises 6 to 9% by weight of the at least one dyestuff with respect to the weight of the para-aramid polymer plus the at least one dyestuff.

4. The process according to claim 1, wherein the at least one dyestuff used to prepare the spin dope in step a) comprises at least one pigment.

5. A process to manufacture a sliver made of spun-dyed para-aramid staple fibers, the process comprising:

g) conducting dried spun-dyed para-aramid filament yarn obtained with the process according to claim 1 into a cutting device or into a stretch-breaking device to obtain cut staple fibers or stretch-broken staple fibers, and h) processing the staple fibers into a sliver.

* * * * *